US006479805B1

(12) United States Patent
Yagi et al.

(10) Patent No.: US 6,479,805 B1
(45) Date of Patent: Nov. 12, 2002

(54) MICROWAVE DEFROSTING UNDER REDUCED PRESSURE

(75) Inventors: Shunichi Yagi; Kazuo Shibata, both of Fujieda (JP)

(73) Assignee: Ellie Corporation, Shizuoka-ken (JP)

( * ) Notice: Subject to any disclaimer, the term of this patent is extended or adjusted under 35 U.S.C. 154(b) by 0 days.

(21) Appl. No.: 09/551,339

(22) Filed: Apr. 18, 2000

(30) Foreign Application Priority Data

Apr. 27, 1999 (JP) ..... 11-119095

(51) Int. Cl.[7] ..... H05B 6/80; H05B 6/68

(52) U.S. Cl. ..... 219/703; 219/686; 219/732; 219/762; 426/241; 426/523

(58) Field of Search ..... 219/703, 725, 219/732, 762, 729, 686; 426/107, 241, 523; 99/DIG. 14

(56) References Cited

U.S. PATENT DOCUMENTS 4,499,356 A * 2/1985 Hatagawa ..... 219/703

5,859,412 A * 1/1999 Yagi ..... 219/704

FOREIGN PATENT DOCUMENTS

| | | | |
|---|---|---|---|
| DE | 43 25 581 | * 2/1995 | |
| JP | 54-36660 | * 3/1979 | ..... 426/241 |
| JP | 63-172831 | * 7/1988 | ..... 219/703 |
| JP | 11-290206 | * 10/1999 | |

* cited by examiner

*Primary Examiner*—Philip H. Leung
(74) *Attorney, Agent, or Firm*—Hedman & Costigan, P.C.

(57) ABSTRACT

A defrosting method and apparatus for defrosting frozen food products which is based on a pressure reducing chamber in which the frozen food products are placed for defrosting; a vacuum pump for reducing the pressure in the pressure reducing chamber to a pressure level at or below the sublimation pressure of said frozen food products; a microwave heating unit; and a support jig for supporting said frozen food products.

4 Claims, 7 Drawing Sheets

MICROWAVE DEFROSTING UNDER REDUCED PRESSURE

BACKGROUND OF THE INVENTION

1. Field of the Invention

The present invention relates to defrosting technology designed to prevent dripping and the loss of quality in the defrosted products. In particular, the present invention relates to defrosting technology in which high-quality defrosting is performed in an extremely short amount of time by carrying out low-energy microwave heating at reduced pressure. Further, the defrosting technology of the present invention can be used in various industries, including the food industry, pharmaceutical industry, cosmetic industry, cattle raising industry, marine products industry, machine manufacturing industry and home electronics manufacturing industry.

2. Description of the Prior Art

In prior art defrosting methods that use microwave heating at reduced pressure, microwave heating is carried out after the pressure has been reduced to a prescribed level (e.g., 25 torr) in order to prevent the product temperature from becoming too high during defrosting, and the progress of the defrosting process is confirmed by relaxation of the reduced pressure level.

In defrosting methods that use a microwave oven, the microwave radiation is emitted intermittently.

Further, there exists a tempering method that uses microwave radiation, in which frozen products are evenly irradiated with microwave radiation while being conveyed on a conveyor in an open atmosphere until defrosting is completed at a minus temperature near 0° C.

In the meat selling industry, frozen meat at a temperature of −40° C. is defrosted by being placed into a refrigerator and left to stand for about two days.

Further, in the expensive fish meat selling industry related to tuna and the like, frozen tuna at −60° C. is defrosted by being immersed in warm salt water at 40° C.

Now, in the prior art defrosting method which uses microwave heating at reduced pressure and in the prior art defrosting method which uses a microwave oven, a slight drip is created during defrosting. As soon as this drip begins to flow, the microwave radiation will concentrate at such location, thereby causing the region where the drip is occurring to be overheated even though temperature inside the frozen products is −10° C., and this results in a marked loss in the quality of the frozen products.

On the other hand, in the tempering method where microwave radiation is used under an open atmosphere, because the temperature of the frozen products is stopped at a minus temperature slightly below 0C., if a strict uniform microwave irradiation of the frozen products is carried out, there will be fewer occurrences of the kind of problem described above for the other defrosting methods. However, uniform irradiation is difficult to achieve with frozen products that have irregular shapes and sizes, and there is the further difficulty involved in accurately establishing microwave irradiation time when the frozen products have various shapes. Accordingly, the problem of dripping can frequently occur when defrosting is carried out to a relatively high temperature such as −1° C. or −2° C.

Furthermore, neither the method of letting frozen products stand over time in a refrigerator nor the method of immersing frozen products in warm salt water can avoid the problem of dripping, and for this reason, frozen products defrosted by these methods will suffer a loss in quality.

SUMMARY OF THE INVENTION

In order to overcome the problems of the prior art and make it possible to obtain defrosted products having a quality higher than that achieved with prior art defrosting methods, it is an object of the present invention to provide a method and apparatus for carrying out high quality defrosting in a short amount of time which creates only a small temperature difference between the inside and outside of the frozen products, with very little oxidation of the frozen products, and without generating a drip from the frozen products regardless of the shape and temperature of the frozen products.

In this regard, the problem usually associated with microwave heating is knowing when to properly terminate the microwave heating. The first way the present invention deals with such problem is to provide an electrical discharge generating mechanism to generate microwave-induced electrical discharges during microwave heating of frozen products previously placed inside a pressure reducing chamber while the pressure is being reduced. In this way, when an electrical discharge due to microwave radiation in the reduced pressure environment is observed to take place during the defrosting process, a proper termination of microwave heating can normally be carried out.

Namely, when a microwave-induced electrical discharge is generated during the microwave heating of frozen products under reduced pressure at a proper microwave output selected in accordance with the weight of the frozen products so as to avoid overheating thereof, the time of such electrical discharge indicates the time for a proper termination of microwave heating. Accordingly, when a microwave-induced electrical discharge is detected in the reduced pressure environment, if the emission of microwave radiation is terminated immediately after the detection of such electrical discharge, it is possible to achieve defrosting without generating a drip. Further, the inside of the pressure reducing chamber is equipped with metallic elements which have single or plural number of sharp edges which include acute angled portions that normally generate precise electrical discharges.

Further, one cause of the generation of dripping is due to a temperature difference between the inside portion and the outside portion of the frozen products. In this connection, when the frozen products are being heated with microwave radiation, the outer portion of the frozen products receive more microwave heating than the inner portion, and this results inevitably in the outer portion having a higher temperature than the inner portion. Further, because microwave radiation penetrates into frozen products from the outside portion thereof, the risk of the outside portion of the frozen products changing into liquid water must normally be taken into consideration. This problem can be solved by making the temperature of the inside portion of the frozen product and the temperature of the outside portion of the frozen product as close as possible. The present invention achieves this by generating sublimation at the outer portion of the frozen products at a minute level that reduces the temperature of the outer portion of the frozen products without affecting the product quality. By repeating this process, the temperature difference between the inner portion and the outer portion of the frozen products can be made gradually smaller.

A method of defrosting frozen products using microwave heating under reduced pressure in combination with a pressure returning step are repeated a plurality of times, the precise time the pressure reducing step is terminated can be controlled by continually detecting pressure level changes at prescribed time intervals. Namely, the pressure reducing step is terminated and the pressure returning step is started when the change in the pressure level reaches a prescribed pressure level. Now, assuming the vacuum pump has no clearance error, if there is no sublimation from the frozen products, each pressure reducing step can simply be terminated at the time a prescribed pressure level is reached. However, vacuum pumps with no clearance error so not exist, and in the present invention sublimation from the frozen products is utilized to reduce the temperature difference between the inside and the outside of the frozen products in order to carry out defrosting without loss of product quality. Consequently, because there is a change in pressure level that needs to be achieved due to the amount of sublimation being generated from the frozen products, there is no way accurate control can be carried out based on the pressure reaching the prescribed pressure level. However, by measuring the termination time of each pressure reducing step tat a fixed rate in accordance with the established prescribed time or the pressure change level, it is possible to obtain a highly accurate level of control regardless of the size of the vacuum pump clearance error and the amount of sublimation.

Either way, a vacuum pump is required to lower the pressure in the pressure reducing chamber to a pressure level at or below the sublimation pressure level that enables sublimation to be generated from the frozen products.

In this present invention, Higher reduced pressure level means higher vacuum, which means chamber pressure is lower. Lower reduced pressure level means lower vacuum, which means chamber pressure is higher.

Further, the judgment of whether or not defrosting is complete can be carried out based on measured pressure changes due to sublimation from the frozen products or measured changes in the weight of the frozen products.

Next, it is believed that dripping is most likely to occur at the parts of the frozen products that come in contact with the support jig holding the frozen products. Namely, if the support jigs are made of materials that become heated by microwave radiation, dripping will be caused by heat being transferred from the support jig to the parts of the frozen products in contact with the support jig. Accordingly, if the support jig is made of materials having a high microwave permeability or high microwave reflectivity, it becomes possible to prevent the support jig from being directly heated by the microwave radiation.

However, even in the case where direct microwave heating of the support jig is avoided by constructing the support jig from a material having a high microwave permeability or high microwave reflectivity, the temperature of the support jig is close to that of the atmosphere inside the pressure reducing chamber, and this allows heat to be transferred from the support jig to the parts of the frozen products in contact with the support jig, thereby causing a temperature rise in the parts of the frozen products in contact with the support jig. In this regard, because the risk of ice being converted to liquid water during microwave heating increases as the surface area of the contact portions becomes larger, this risk can be eliminated by making the surface area of the portions of the support jig that come into contact with the frozen products as small as possible. In the case where the frozen products are supported on top of the support jig, the portions of the support jig in contact with the frozen products can be reduced by using rod-shaped members, lattice-shaped members, protruding members or perforated members to support the frozen products, and in the case where the frozen products are hung from the support jig, the portions of the support jig in contact with the frozen products can be reduced by using string members, net members or hook members.

Now, in both the case where the frozen products are supported on top of the support jig and the case where the frozen products are hung from the support jig, the support jig may be fixed or rotated so long as it is possible to carry out uniform microwave heating.

Further, in the case where too high of a microwave output level is used for the weight of the frozen products, microwave radiation will concentrate at the protruding parts of the outside portion of the frozen products and cause overheating thereof, which in turn can cause the formation of liquid water. In order to prevent this problem, the present invention employs a microwave generator which includes a circuit for selecting a microwave output level in a stepwise or stepless manner in accordance with the weight of the frozen products.

Further, depending on the type of frozen products, there are cases where the defrosting temperature control requires a higher level of accuracy, such as in the case of pharmaceutical products, and in these cases a strict temperature control may be carried out by means of an optical fiber thermometer or the like.

Further, a pressure level adjustment valve is provided between the pressure reducing chamber and the vacuum pump, and by using this pressure level adjustment valve to let air flow in toward the vacuum pump, it is possible to adjust the pressure level without introducing air into the pressure reducing chamber. Accordingly, because defrosting is carried out under oxygen-free conditions, almost no oxidation takes place, and this makes it possible to carry out defrosting while maintaining a high degree of product quality.

Next, the usefulness of microwave heating of the frozen products will be described.

In this regard, even though the frozen products has a much lower loss coefficient than liquid water, the frozen products is certainly not permeable to microwave radiation, and because the microwave half-value penetration depth is quite deep for ice, once microwave radiation has been introduced, such microwave radiation is extremely efficient at heating, and this makes it possible to rapidly raise the temperature of the frozen products. In this connection, experiments have confirmed that microwave radiation is extremely efficient at heating the frozen products so long as there are no other substances present which have a high loss coefficient, such as liquid water. On the other hand, the presence of only a very small amount of liquid water causes the microwave radiation to concentrate at the location of such liquid water, and because this takes away almost all the microwave heating of the frozen products, the defrosting process is interrupted. For this reason, it is necessary to prevent liquid water dripping from the frozen products during the defrosting process.

To confirm the reasoning giving above, a comparison experiment was carried out in which liquid water and the frozen sample were irradiated with microwave radiation. Namely, a liquid water sample constructed of a material having a prescribed amount of liquid water and a frozen sample constructed of the same material having the same amount of water in the form of ice were separately irradiated with microwave radiation to determine the relative amount of microwave radiation reflected from the liquid water and frozen sample. From the results of this experiment, it was found that the amount of microwave radiation reflected from the liquid water sample was about 30% of the amount of microwave radiation reflected from the frozen sample. Further, the results of comparing the microwave loss coefficients respectively measured for the liquid water and frozen sample showed the liquid water sample to absorb more microwave radiation than the frozen sample. On the other hand, the results of comparing temperature rises showed the opposite phenomenon to be true. Namely, at the same pressure level and microwave output level, the temperate rise for the frozen sample was higher than that for the liquid water sample. This is due to the fact that the specific heat of ice is about 50% of the specific heat of liquid water, as well as to the fact that the microwave half-value penetration depth of ice (at −40° C.) for microwaves having a frequency of 2,450 MHz, for example, is 780 cm, which is quite large compared with 1.3 cm for the case of liquid water. As a result of such experiments, it was found that even though less microwave radiation will penetrate into ice than into liquid water due to the lower microwave loss coefficient of the frozen products, once such microwave radiation penetrates the frozen products, the heating achieved thereby will be extremely efficient due to ice's large microwave half-value penetration depth.

Next, in order to confirm the requirement for there to be no dripping from the frozen products, a small sponge containing liquid water was placed in a pressure reducing chamber together with a frozen sample, and with an optical fiber thermometer inserted into the frozen sample, microwave heating was carried out. As a result, it was found that only a very small temperature increase occurred in the frozen sample, and this made defrosting impossible. Next, the sponge containing liquid water was removed, and then microwave heating was carried out on the frozen sample. As a result, an extremely smooth temperature increase occurred. Consequently, such experiments confirmed that even a small amount of dripping from the frozen products will make defrosting difficult.

Next, the high efficiency achieved when defrosting is performed by carrying out microwave heating under reduced pressure can be understood from the fact that the specific heat of the frozen products will be smaller in a reduced pressure environment than in the open atmosphere, and this makes it possible for the temperature of the frozen products to be raised at a very rapid rate using a small amount of microwave energy. For example, microwave energy at about 3 kW is required to defrost about 10 kg of frozen products under an open atmosphere, while only 1 kW or less is required for defrosting the same amount of frozen products under a reduced pressure environment. Further, because a reduced pressure environment makes it possible to carry out defrosting in a roughly oxygen-free environment, it is possible to prevent oxidation and thereby obtain high quality defrosted products.

Next, a description will be given for the way in which control is carried out to terminate microwave heating upon detection of a microwave-induced electrical discharge. In general, in the case where there is little or no material that microwave radiation can easily act upon under a reduced pressure environment, it becomes extremely easy for electrical discharges to occur as the pressure level is reduced. Further, as described above, because microwave radiation is extremely efficient in acting upon the frozen products, even when there is no liquid water present, no electrical discharge will occur during the time that sufficient microwave radiation is penetrating the frozen products. On the other hand, from observations of the relationship between microwave-induced electrical discharges and temperature changes of the frozen products, it was found that the amount of reflected microwave radiation increases as the temperature of the frozen products rises during defrosting by microwave heating under reduced pressure. This indicates that the amount of microwave radiation not penetrating the frozen products is increasing. After this state continues for some time, microwave-induced electrical discharges will occur. Accordingly, as the amount of microwave radiation not penetrating the frozen products increases together with the rising temperature of the frozen products, it was confirmed that microwave-induced electrical discharges occur once such excess microwave radiation goes above a prescribed amount. Further, so long as an appropriate output level was used when carrying out microwave heating of the frozen products, observations showed that microwave-induced electrical discharges will definitely occur right before the ice of the frozen products changes into liquid water. This indicates that a microwave-induced electrical discharge will occur before a drip is generated from the frozen products, so long as an appropriate output level is used when carrying out microwave heating of the frozen products. As a result, it becomes extremely easy to carry out highly accurate microwave heating.

Further, in order to confirm the fact that the microwave heating of the frozen products is carried out efficiently, and the fact that microwave-induced electrical discharges inevitably occur as the temperature of the frozen products rises, an experiment was carried out in which frozen products tightly wrapped in a resin permeable to microwave radiation were defrosted by microwave heating under reduced pressure. During this experiment, the level of microwave penetration into the frozen products was monitored, and after an electrical discharge was detected, the condition of the frozen products was examined. As a result, depending on the output level, it was found that microwave radiation can penetrate into the frozen products in a reduced atmosphere down to about 2 torr even without the presence of liquid water. Further, an electrical discharge was observed to occur after the temperature rose to a certain level, and to the extent that there was no excessive penetration of microwave radiation, examination of the frozen products immediately after the occurrence of the electrical discharge did not reveal any dripping. Moreover, when this experiment was repeated using such method of terminating the microwave heating upon detection of an electrical discharge, the same results were obtained. These experimental results indicate that the excessive build up of microwave radiation due to the rising temperature of the frozen products will induce an electrical discharge to occur before a drip is generated from the frozen products, so long as no liquid water is present and microwave heating is not carried out at an excessive level.

At this point, it should be noted that the relationship discovered by the present invention is different from the relationship connected with liquid water, microwave radiation and electrical discharges known in prior art reduced pressure drying technology, in which it is known that electrical discharges will not occur when a dielectric such as liquid water is sufficiently present in a reduced pressure environment at a pressure level of 10 to 20 torr, and that electrical discharges will occur when there is relatively little liquid water present. Namely, when defrosting is carried out at an output level of 1 kW, for example, the relationship discovered in the present invention shows that microwave-induced electrical discharges will not occur for some time so long as the frozen products is present at a temperature which allows penetration by microwave radiation, even when the pressure is reduced to a relatively high pressure level of about 2 torr, and that an appropriately sensitive electrical discharge will occur at the microwave output level of 1 kW due to the excess microwave radiation generated as the temperature of the frozen products rises, even when the pressure is in the range of 10 to 40 torr, and this relationship is different from the relationship connected with liquid water, microwave radiation and electrical discharges known in prior art reduced pressure drying technology. Accordingly, the principle, detection means and phenomena related to detecting electrical discharges in the defrosting technology of the present invention is completely different from that related to detecting electrical discharges in prior art reduced pressure drying technology.

In other words, the relationship discovered in the present invention related to reduced pressure, the frozen products and microwave-induced electrical discharges is completely unknown in the prior art. Further, it was discovered that a proper termination of microwave heating could be carried out based on the principle of such electrical discharges, and such fact has been sufficiently confirmed by experiment.

Further, the relationship discovered in the present invention related to reduced pressure, the frozen products and microwave-induced electrical discharges makes it possible to vastly improve defrosting control, and is extremely advantageous with regards to reliability and accuracy regardless of the type, shape and temperature of the frozen products. Accordingly, the present invention makes it possible to carry out defrosting in a short amount of time while maintaining a high level of product quality.

In this connection, in order to make it possible for microwave-induced electrical discharges to be generated in a stable manner, in the example defrosting system shown in FIG. 1, one or a plurality of metallic members 13 having acute angled portions is provided inside a pressure reducing chamber 1 at a location which will not cause microwave damage to the frozen products. In this way, because the acute angled portions of the metallic members 13 are the sharpest angled metal portions inside the pressure reducing chamber 1, microwave-induced electrical discharges will only be generated at the acute angled portions of the metallic members 13. Further, a detector 8 is provided to detect such electrical discharges, and after an electrical discharge is detected, the detector sends a signal to a microwave generator 6 instructing the microwave generator 6 to terminate emission of microwave radiation. For detecting electrical discharges, the detector 8 may employ an ultraviolet detection method, an electrical discharge sound detection method or any other appropriate method for detecting electrical discharges.

Further, the metallic members 13 that have acute angled portions may include metallic members having needle-shaped ends, metallic members having corrugated ends, or metallic members formed with ends shaped like a stirrer or the like in order to agitate the microwave radiation. In this regard, each shape and mounting location must meet the requirement that microwave radiation is not obstructed.

Next, the required pressure reducing performance of the vacuum pump will be described.

During the defrosting process, the temperature of the outside portion of the frozen products becomes higher than the temperature of the inside portion of the frozen products. For example, even when the temperature of the outside portion of the frozen products is −1° C., the temperature of the inside portion can be as low as −8° C., and this is believed to be one cause of the generation of dripping. Now, if the vacuum pump can lower the pressure to a pressure level at or below 4.579 torr, sublimation will occur at the outside portion of the frozen products, and this sublimation will act to reduce the temperature of the outside portion of the frozen products without degrading product quality. By repeating this process, it becomes possible to shrink the temperature difference between the outside portion and the inside portion of the frozen products. Further, if this process is repeated as shown in FIG. 2, the temperature difference between the inside portion and the outside portion of the frozen products can be virtually eliminated, thus making it possible to obtain optimum defrosting results. Furthermore, with regards to frozen products that allow drying of the surface of the frozen products, the pressure can be held at or below the sublimation temperature for a prescribed period of time to make the temperature of the outside portion of the frozen products lower than the temperature of the inside portion of the frozen products. For example, with the inside temperature of the frozen products at −1° C., the temperature of the outside portion can be lowered to −2° C. Accordingly, in order to lower the temperature of the outside portion of the frozen products, the vacuum pump must be able to lower the pressure inside the pressure reducing chamber to a pressure level at or below the sublimation pressure for the frozen products.

Thus, when a pressure reducing step and a pressure returning step are repeated a plurality of times, in order to bring the temperature of the outside portion of the frozen products close to the temperature of the inside portion without overdrying the surface of the frozen products, it is necessary to establish a prescribed judgment reference for terminating each pressure reducing step. However, the error due to the clearance of the vacuum pump normally makes if difficult to reach the prescribed pressure level, and the pressure level that can be reached will change depending on the amount of sublimation vapor generated from the frozen products. In order to solve such problems, the change in the pressure level is continually measured at prescribed time intervals, with judgments being made when such changes reach a prescribed pressure level change. Now, because the pressure level changes in accordance with the amount of sublimation vapor produced from the frozen products, this method makes it possible to detect the amount of sublimation vapor generated, regardless of the pressure level value. Similarly, regardless of the pressure level error due to the clearance of the vacuum pump, the amount of sublimation vapor generated can be determined at a fixed rate from measurements take at prescribed time intervals for prescribed pressure level changes. For the example shown in FIG. 3, in which the prescribed time intervals is 30 seconds and the prescribed pressure level changes is 0.1 torr, the pressure level at the end of each prescribed time interval is compared with the pressure level measured 30 seconds prior to the current measurement, and when the change in pressure falls to 0.1 torr, the pressure reducing step is terminated. On the other hand, if the prescribed time interval is set at 15 seconds, less time will be required for the change in pressure to fall to 0.1 torr compared to the case of the 30 second time interval, and this results in less sublimation vapor being produced. Accordingly, overdrying of the surface of the frozen products can be prevented by establishing appropriate values for the prescribed time interval and the prescribed pressure change.

Next, a description will be given for and example control method for controlling the termination to the defrosting process based on changes in pressure due to sublimation from the frozen products. Namely, when sublimation is generated from the frozen products in a prescribed pressure range, the higher the temperature of the frozen products, the greater the amount of sublimation vapor created, and this makes it difficult to reach low pressure levels. Consequently, because the temperature of the frozen products is low at the beginning of the defrosting process, there will only be a small amount of sublimation generated, and this will make it easy to reach a low pressure level, but as the defrosting process progresses, the temperature of the frozen products rises, and because this leads to a greater amount of sublimation being generated from the frozen products, the pressure level will rise. In connection, FIG. 4 shows an example of the pressure levels reached during each pressure level step, in which the curve "c" represents pressure levels at the beginning of the defrosting process, and the curves "b" and "a" represent pressure levels that exist as the temperature of the frozen products increases during the progression of the defrosting process. Then, if the difference in the pressure levels reached during each pressure reducing step are compared and the defrosting process is terminated at the time when a prescribed pressure level difference is reach it becomes possible to ensure a stable defrosting termination temperature.

Further, there exists another method of controlling the termination of the defrosting process, in which control is carried out based on the reduction in weight of the frozen products due to sublimation. In this connection, FIG. 5 shows an example of the loss in weight of the frozen products for each pressure reducing step, and as shown in this drawing, there is a slight reduction in the weight of the frozen products each time sublimation is repeated. Further, the results of many experiments show that a successful defrosting is achieved with the method of the present invention when the weight loss after defrosting relative to the original weight of the frozen products is within 0.8%. Accordingly, by using this value as a reference for comparing the weight of the frozen products after each pressure reducing step with the original weight of the frozen products at the beginning of the defrosting process, it is possible to terminate the defrosting process at the time when a prescribed change in weight is reached. In this connection, any appropriate weight measuring methods and devices may be used for measuring the weight of the frozen products, including the use of a load cell which measures the weight of the entire defrosting apparatus.

Next, a description will be given for the jig used to support the frozen products. First, the jig must not be heated by microwave radiation. This is an essential requirement, because if the jig were to be heated, a drip would inevitably occur at the points in contact with the frozen products. Accordingly, the jig should be made from a resin having a high permeability to microwave radiation such as fluororesin, polysulfone resin, polypropylene resin and "peek plastic" which was approved by the U.S. FDA for use with foodstuffs some time ago, ceramics having a high permeability to microwave radiation, or a metal having a high reflectivity such as stainless steel.

Furthermore, even if the jig is made from a material having a high permeability to microwave radiation or a high reflectivity, because the temperature of the jig at the beginning of the defrosting process is close to that of the atmospheric temperature inside the pressure reducing chamber, the temperature of the jig starts out higher than the temperature of the frozen products. Consequently, because this results in the heat being transferred from the jig to the frozen products, the greater the contact area between the jig and the frozen products, the more likely dripping will occur at such contact areas. In order to prevent such cause of dripping, in the present invention the surface area of the portions of the jig which come in contact with the frozen products is made extremely small so as prevent heat transfer. In this connection, FIGS. 6(*a*)–(*d*) show four possible examples of shape members that can be used when the frozen products are supported on top of the jig, in which (*a*) shows rod-shaped members, (*b*) shows lattice-shaped members, (*c*) shows protruding members and (*d*) shows perforated members. Of these four choices the protruding members shown in (*c*) are preferred because the provide point contact at a plurality of points. Further, FIGS. 6(*e*)–(*g*) show string members, net members and hook members used for reducing the contact area in the case where defrosting is carried out by hanging the frozen products from the support jig.

Further, in both the case where the frozen products are supported on top of the jig and the case where the frozen products are hung from the jig, the jig may be fixed in place or rotated so long as uniform microwave heating can be carried out.

Next, it should be noted that in the present invention the pressure level and the change in the pressure level must be measured in units of $10^{-1}$ torr or smaller, because measurements taken in units of 1 torr will not make it possible to achieve accurate control. Namely, in order to accurately determine the time defrosting should be terminated, pressure changes due to minute sublimation need to be measured in units of $10^{-1}$ torr or smaller. This is due to the fact that it is not possible to accurately measure the generation of sublimation if measurements are made in units of roughly 1 torr, and such inaccuracy would make it difficult to prevent overdrying of the surface of the frozen products.

Further, in the case of pharmaceutical products and the like where the target defrosting temperature for the frozen products needs to be strictly controlled, direct temperature measurements of the frozen products are preferably taken using an optical fiber thermometer or the like. In this regard, because the position where the temperature is measured can not possibly indicate the temperature at all positions, control needs to be carried out using one or more control methods.

Furthermore, by providing a circuit to select an appropriate microwave output level in a stepwise or stepless manner in accordance with the weight of the frozen products, the present invention makes it possible to prevent the frozen products from being heated with microwave radiation at too high of an output level. In this way, it becomes possible to prevent the dripping that can occur from the small protrusions normally present on the frozen products when the frozen products are heated at too high of a microwave output level. Now, in the defrosting method which uses microwave heating under reduced pressure, because defrosting can be carried out rapidly with less microwave energy than is required under normal atmospheric conditions, a variable control needs to be carried out to lower the microwave output in order to prevent the frozen products from being heated at too high of a microwave output level. In this regard, based on the correlation between the weight of the frozen products and the microwave output level known up to the present time, example microwave output levels are 0.4 kW for approximately 3 kg of frozen products, 0.5 kW for approximately 5 kg of frozen products, 0.6 kW for approximately 7 kg of frozen products, 0.7 kW for approximately 9 kg of frozen products, and 1.0 kW for approximately 15 kg of frozen products.

Further, by providing a pressure adjustment valve at a location between the pressure reducing chamber and the vacuum pump, as done with the valve 4 shown in FIG. 1, when the pressure needs to be returned in accordance with the method of the present invention to a value of 40 torr, for example, it becomes possible introduce a prescribed flow of air that will only flow toward the vacuum pump. In this way, it becomes possible to change the pressure level by lowering the pressure reducing performance of the vacuum pump without introducing air into the pressure reducing chamber. Accordingly, it becomes possible to carry out high quality defrosting under an oxygen-free environment.

Moreover, by terminating microwave heating upon detection of a microwave-induced electrical discharge in accordance with defrosting methods, it becomes possible to carry out just the right amount of microwave heating of the frozen products. Accordingly, if this heating is controlled to a high degree of accuracy, no drip will be generated, and this makes it possible to obtain high quality defrosted products. Further, by carrying out such control in which microwave heating is terminated upon deletion of a microwave-induced electrical discharge, it becomes possible to obtain high quality defrosted products, regardless of the weight, shape or temperature of the frozen products. In this regard, when such highly accurate method of terminating microwave heating upon detection of a microwave induced electrical discharge was tested by experiment, it was the first time an absolutely drip-free defrosting was observed to have been achieved. At the same time, because defrosting is carried out under reduced pressure, it is possible to obtain defrosted products having only a minute amount of oxidation, and because the specific heat of ice is lower under reduced pressure than at normal atmospheric conditions, a lower microwave output level is required, and this makes it possible for defrosting to be carried out in a short amount of time. lower microwave output level is required, and this makes it possible for defrosting to be carried out in a short amount of time.

Further, by providing one or more metallic members having acute angled portions inside the pressure reducing chamber at a location which will not cause microwave damage to the frozen products, microwave-induced electrical discharges can be made to normally occur at such angled portions, and this makes it possible to carry out an extremely stable control.

Moreover, by using the vacuum pump to reduce the pressure to a level that allows sublimation to the take place at the outside portion of the frozen products, it becomes possible to decrease the temperature difference between the inside portion an the outside portion of the frozen products, and for the particular case where thick frozen products are to be defrosted, this method make it possible to carry out high quality defrosting while maintaining a uniform temperature for the inside and outside portions of the frozen products.

Furthermore, by monitoring the change in pressured caused by sublimation, it becomes possible to accurately determine the time when defrosting should be terminated. Such determination can also be made by monitoring the change in weight of the frozen products caused by sublimation.

Further, by arranging a pressure adjustment valve between the pressure reducing chamber and the vacuum pump, it becomes possible to change the pressure level without introducing air into the pressure reducing chamber, and this in turn makes it possible to carry out high quality defrosting while preventing oxidation of the frozen products.

Moveover, by carrying out measurements in unit of $10^{-1}$ torr or smaller, it becomes possible to determine the generation of even minute quantities of sublimation vapor, and this makes its possible to carry out high quality defrosting without overdrying the surface of the frozen products.

Furthermore, by constructing the jig in a manner that prevents the jig from heated, and by constructing the jig in a manner that prevents heat from being transferred from the jig to the frozen products, it becomes possible to eliminate dripping from the frozen products due to heat from the jig.

Further, by adjusting the microwave output level in accordance with the weight of the frozen products, it becomes possible to eliminate overheating of the small protrusions of the frozen products caused by microwave heating carried out at too high of an output level.

Moveover, by using an optical fiber thermometer, it becomes possible to provide strict defrosting temperature control required for frozen products such as pharmaceutical materials.

In short, the present invention provides a defrosting method and apparatus which make it possible to carry out defrosting without a drip being generated from the frozen products. This control achieved with the present invention is based on the discovery that a proper termination of microwave heating can be carried out upon detection of a microwave-induced electrical discharge, whereby it becomes possible to carry out defrosting control at an accuracy level higher than anything achieved in the past.

Furthermore, by carrying out defrosting under reduced pressure, it is possible to obtain defrosted products having almost no oxidation. Further, because a lower microwave output level can be used when carrying out microwave heating under reduced pressure, the present invention provides a defrosting method that makes it possible to carry out defrosting at an extremely rapid rate, and this makes the present invention useful for mass processing.

Further, by arranging the vacuum pump to reduce the pressure to a level low enough for sublimation to occur, it becomes possible to lower the temperature of the outside portion of the frozen products by generating sublimation at such outside portion of the frozen products, and this makes it possible to obtain defrosted products having a uniform temperature in the inside and outside portions.

In accordance with the advantages described above, the present invention makes it possible to obtain defrosted products having a high product quality at an extremely low defrosting cost.

Accordingly, the present invention can be used to carry out defrosting in various industries. In particular, in industries such as the meat industry and the high-quality fresh fish industry where defrosting has been difficult up to now due to problems related to product quality and transportation, the present invention provides a defrosting method that makes it possible to obtain defrosted products having a higher product quality in a short amount of time, and because this in turn makes it possible to reduce transportation costs while achieving high product quality, the present invention enables industry to meet the needs of the consumer. For example, because high quality defrosting has been difficult up to now in the meat industry, there has been a tendency to switch from frozen transport to chilled transport. However, chilled transport has a shorter freshness period, and this together with the other disadvantages of chilled transport leads to high transportation costs. On the other hand, because the present invention makes it possible to achieve an extremely high quality defrosting, frozen transport can be used instead of chilled transport, and this makes it possible to reduce transportation costs.

Further, in the high-quality fresh fish industry which sells Japanese sashimi, there was a limit to how much fish could be defrosted by prior art defrosting methods, and such methods usually created large defrosting losses. However, with the method of the present invention, it becomes possible to eliminate such defrosting losses and obtain high quality defrosted products.

Furthermore, with regards to the machine industry, by providing a new defrosting apparatus at a low cost, the present can be used to carry out industrial defrosting, and this in turn will stimulate developments in freezing technology. Further, even in the household electronics industry, the defrosting apparatus of the present invention can be made compact for high efficiency use in hotel and restaurant businesses, as well being adaptable for future high-quality household electronics.

BRIEF DESCRIPTION OF THE DRAWINGS

FIG. 1(*a*) is a system flow sheet (in which the dashed lines indicate the flow of signals).

FIG. 1(*b*)

FIG. 1(*b*) is a system flow sheet of the case where and optical fiber thermometer is provided (in which the dashed lines indicate the flow of signals).

FIG. 2 is an example of a defrosting chart (in which microwave heating is indicated by bold line portions, microwave suspension is indicated by dashed lines, and electrical discharges are indicated by "☆")

FIG. 3 is a rough explanatory drawing showing the changes in pressure measured for each prescribed time interval.

FIG. 4 is rough explanatory drawing related to the control used in determining in the termination of defrosting.

FIG. 5 is a rough explanatory drawing related to the control us ed in determining the termination of defrosting.

FIG. 6(1) shows example jigs on which the frozen products are supported during defrosting (with the jigs being fixed or rotated).

(a) rod-shaped jig
(b) lattice-shaped jig
(c) protrusion-shaped jig
(d) perforated jig

FIG. 6(2)

FIG. 6(2) shows example jigs from which frozen products are hung during defrosting (with the jigs being fixed or rotated).

(e) cord-shaped jig
(g) hook-shaped jig

DETAILED DESCRIPTION OF THE PREFERRED EMBODIMENTS

Next, a description of specific embodiments will be given.

Specific Embodiment 1

Figure 1:
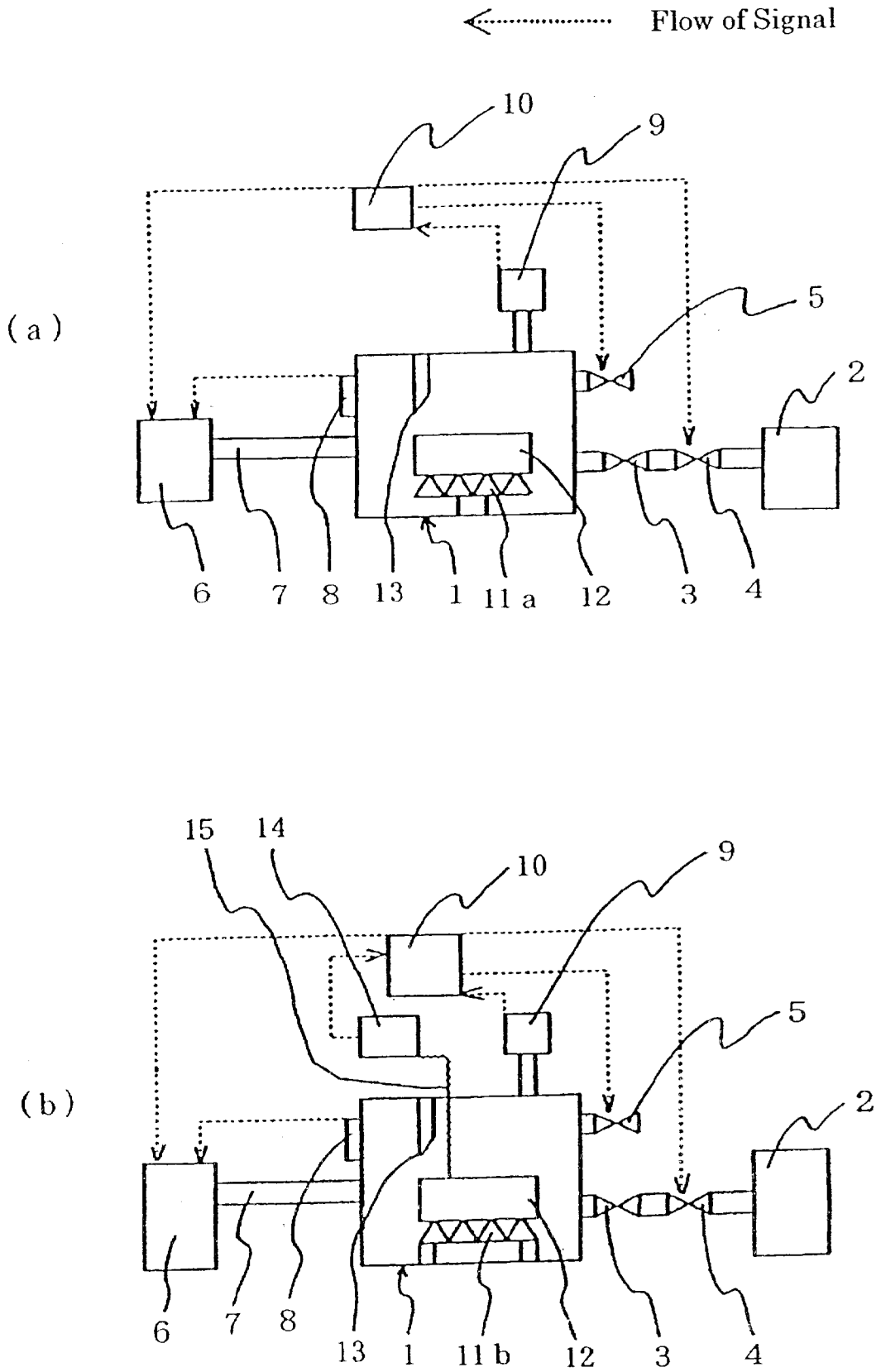
FIG. 1(*a*)
Figure 2:
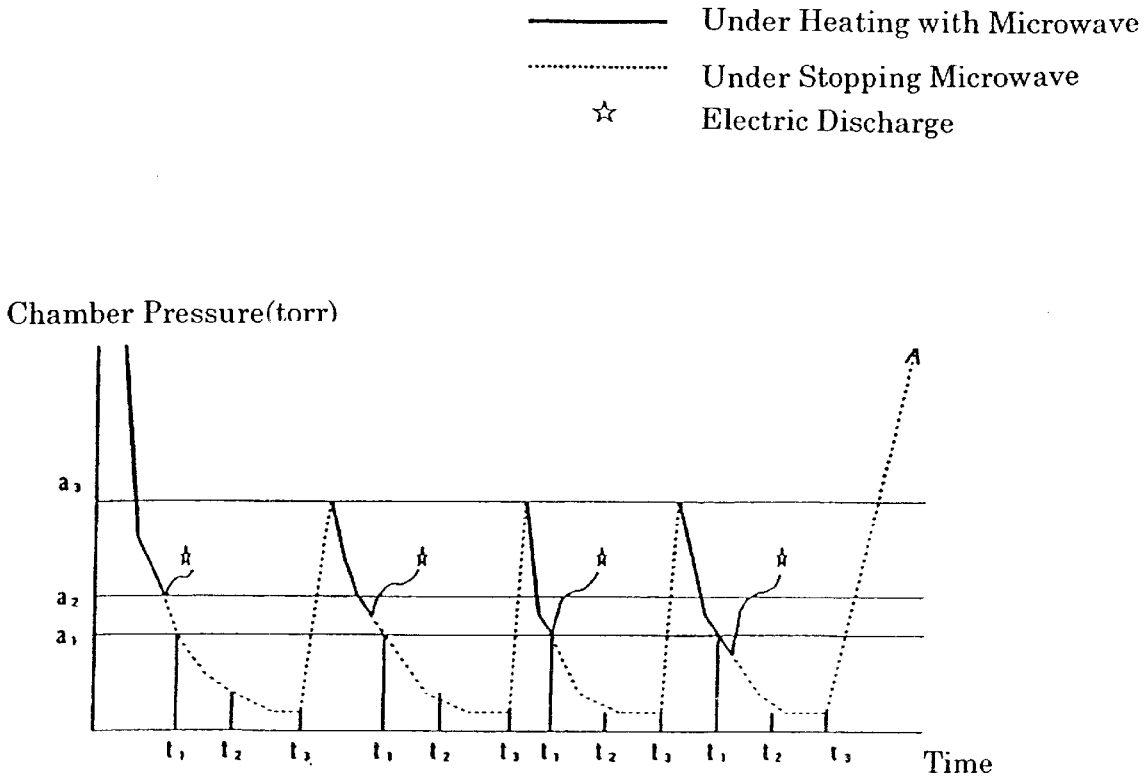
FIG. 2
Figure 3:
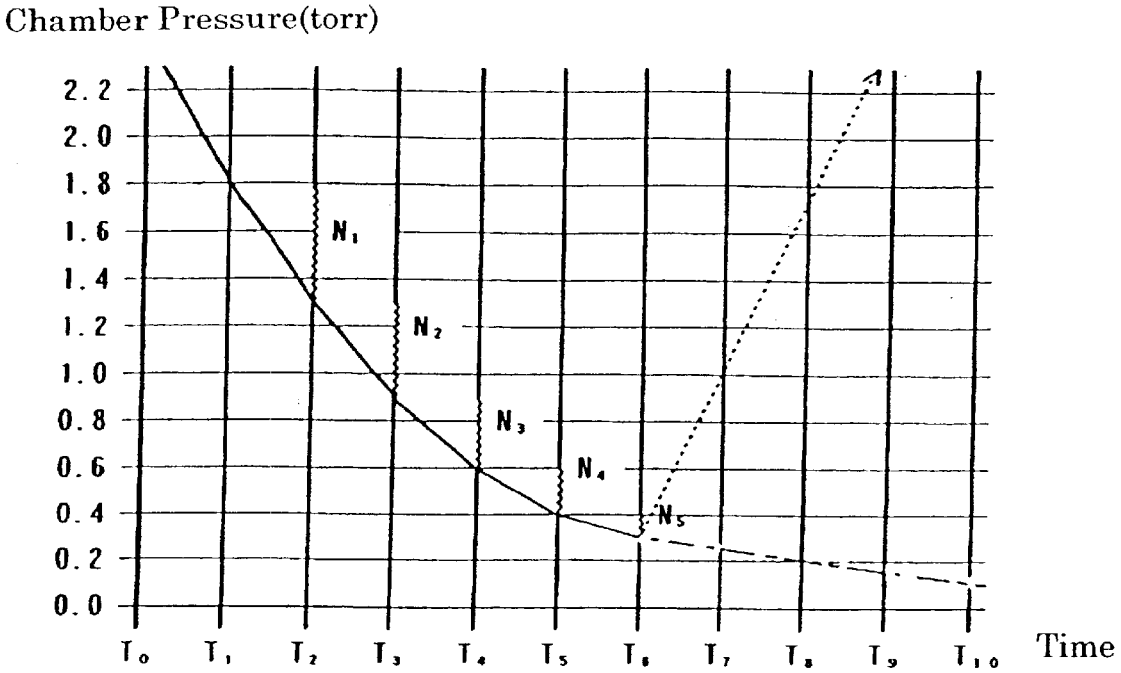
FIG. 3
Figure 4:
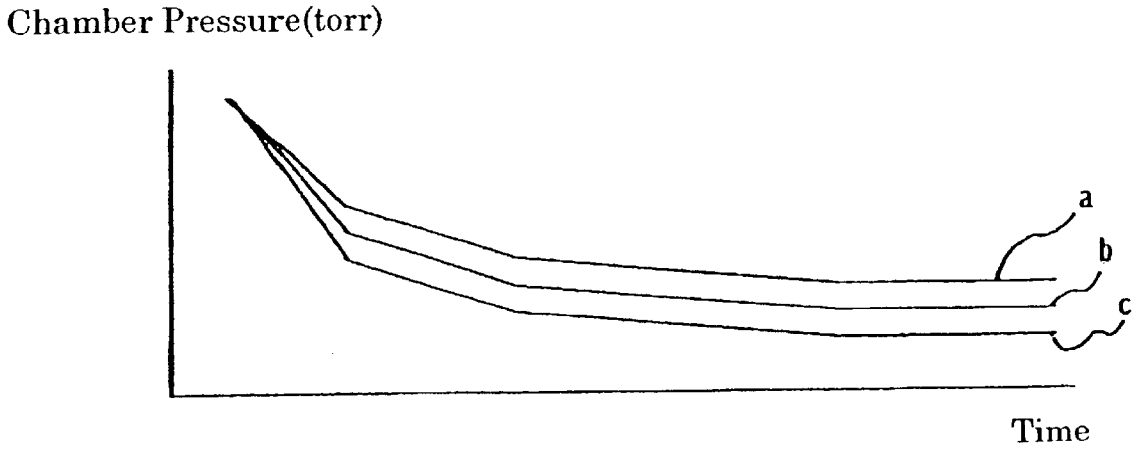
FIG. 4
Figure 5:
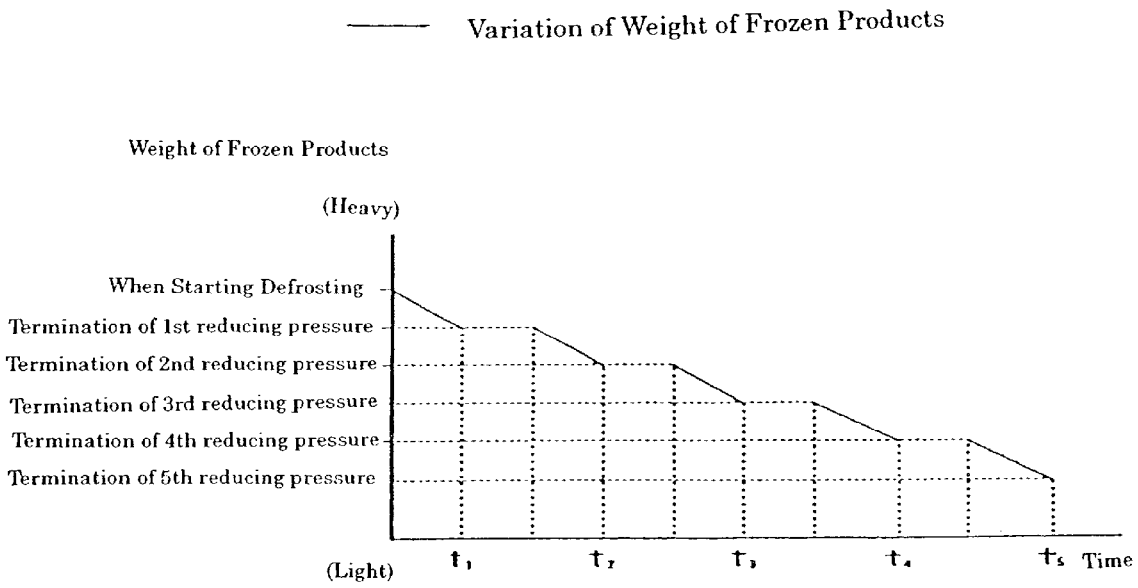
FIG. 5
Figure 6A:
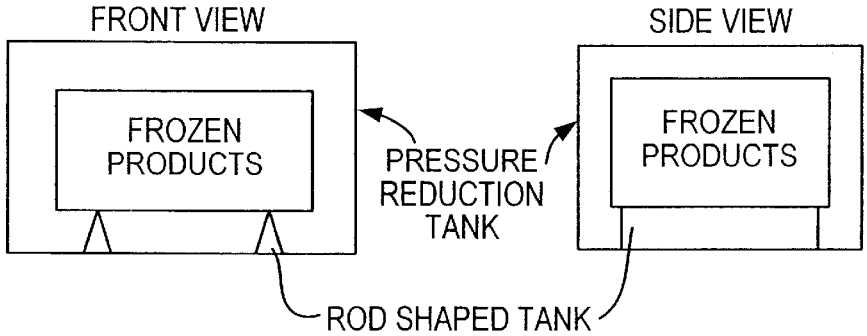
FIG. 6(1)
Figure 6B:
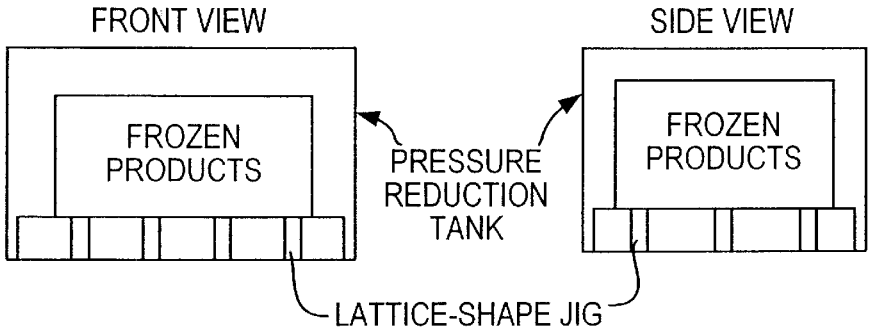
Figure 6C:
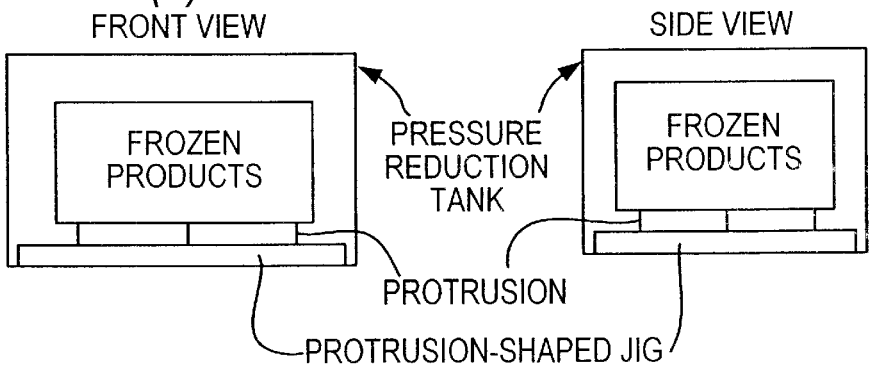
Figure 6D:
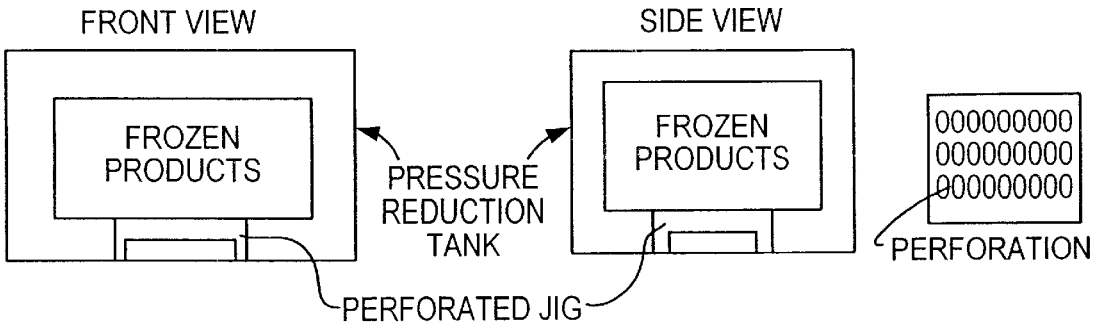
Figure 6E:
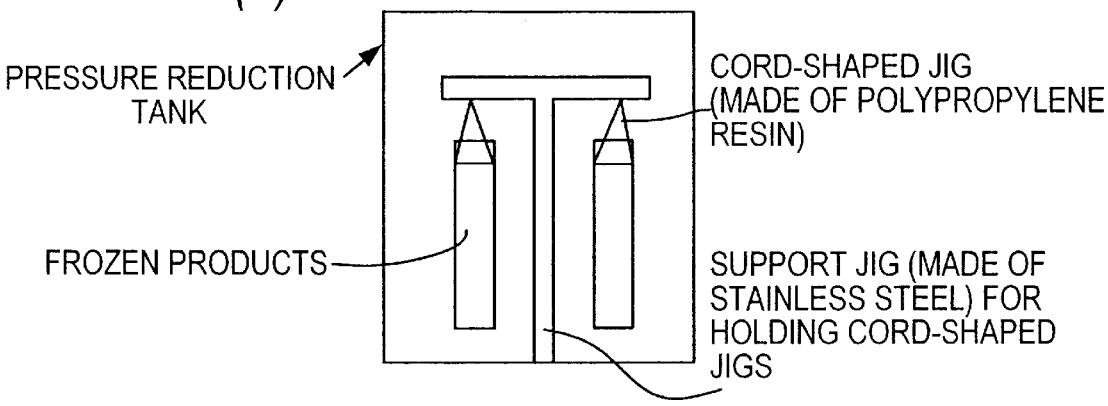
Figure 6F:
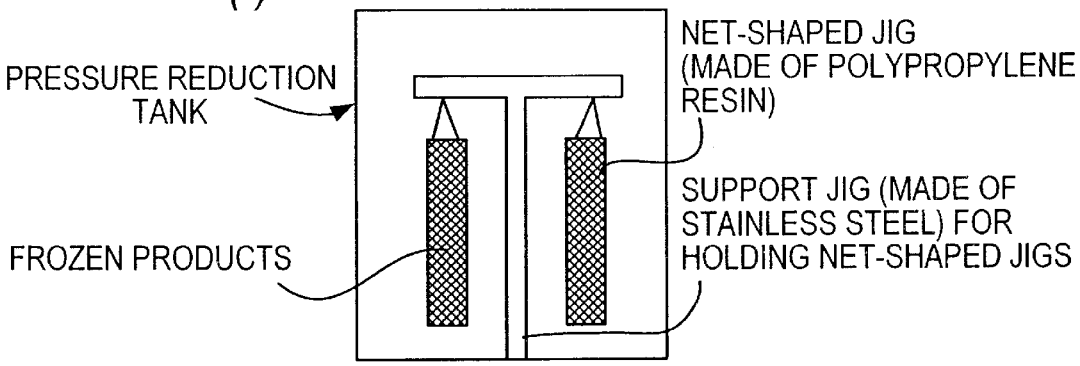
Figure 6G:
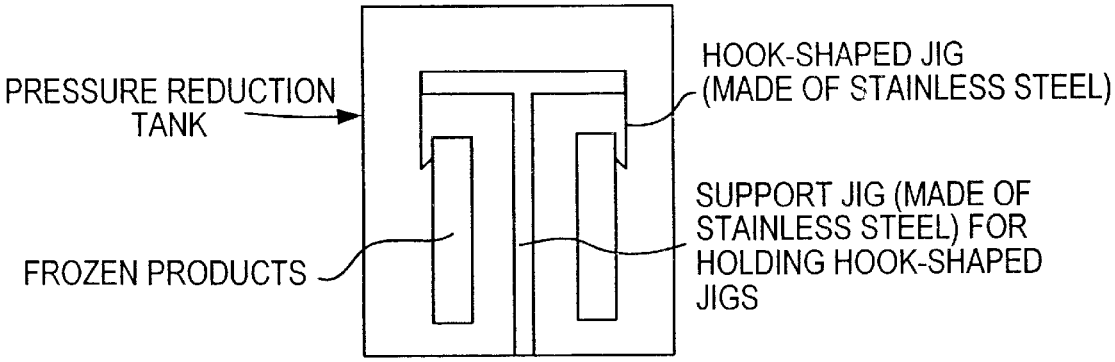

Six kilograms of frozen beef in the form of three 2-kg blocks were placed inside a stainless steel pressure reducing chamber 1 having a width of 600 mm, a height of 600 mm and a depth of 700 mm, and then defrosting was carried out. During such defrosting process, a vacuum pump 2 for example, dry pump was used at an output level of 3 kW to reduce the pressure toward a target pressure level of 1.5 torr, microwave heating was carried out at an output level of 0.6 kW, and changes in pressure were brought about using a pressure adjustment valve 4 in a manner that did not introduce air into the pressure reducing chamber during the defrosting process. Further, the pressure was measured in units of 0.1 torr, and the frozen beef was supported by two triangular bars made of fluororesin to create line contact or point contact, whereby the contact area between the bar and the frozen beef was made very small. The temperature of the frozen beef at the beginning of the defrosting process was −40° C., and the defrosting temperature was confirmed by measuring the temperature inside the frozen beef with an optical fiber thermometer inserted to a depth of 40 mm. In FIGS. 1(*a*) and (*b*), 3 is exhaust valve, 5 is pressure return valve, 6 is microwave generator, 7 is wavelength, 8 is electrical discharge detection device, 9 is pressure gauge, 10 is control portion, 11*a* is rotatable jig for supporting frozen products, lib is fixed jig for supporting frozen products, 12 is frozen products, 13 is metallic member which includes acute angled portion (at discharge generating position), 14 is optical fiber thermometer and 15 is temperature sensor. A summary of the defrosting process is shown in the table below. 6 is microwave generator, 7 is waveguide, 8 is electrical discharge detection device, 9 is pressure gauge, 10 is control portion, 11*a* is rotatable jig for supporting frozen products, 11*b* is fixed jig for supporting frozen products, 12 is frozen products, 13 is metallic member which includes acute angled portion (at discharge generating position), 14 is optical fiber thermometer and 15 is temperature sensor. A summary of the defrosting process is shown in the table below.

TABLE A

| Time of Microwave Heating | Variation of Temperature | Electrical Discharge at Chamber Pressure | Chamber Pressure at Termination of Reducing Pressure |
|---|---|---|---|
| 1st Microwave Heating | −40.0° C. → −22.8° C. | 10.6 torr | 2.1 torr (Standard Value) |
| 2nd Microwave Heating | −23.9° C. → −11.5° C. | 4.5 torr | 2.2 torr(+0.1) |
| 3rd Microwave Heating | −12.8° C. → −6.3° C. | 3.7 torr | 2.3 torr(+0.2) |
| 4th Microwave Heating | −7.3° C. → −4.3° C. | 4.2 torr | 2.4 torr(+0.3) |
| 5th Microwave Heating | −4.9° C. → −2.8° C. | 4.8 torr | 2.5 torr(+0.4) |
| 6th Microwave Heating | −28° C. → −1.5° C. | 6.5 torr | 2.6 torr(+0.5) |
| 7th Microwave Heating | −1.9° C. → −1.1° C. | 7.2 torr | 2.7 torr(+0.6) |

This defrosting process required 24 minutes and 30 seconds to complete. Temperature measurements taken after the defrosting process was terminated revealed an average temperature of −2.0° C. for the inside portion, and an average temperature of −1.1° C. for the outside portion. No dripping was generated. Further, the return pressure was 40 torr for the plurality of microwave heating steps.

Specific Embodiments 2

Eight kilograms of the frozen tuna in the form or four 2-kg blocks were defrosted under conditions similar to those described in Specific Embodiment 1. However, in this case microwave heating was carried out at an output level of 0.7 kw. In this connection, because these blocks include skin and bones at harvest time, if they can be defrosted while maintaining a high quality, the defrosted product will yield 5–10% sashimi or sushineta. In the test conducted in this embodiment, the temperature of the frozen tuna at the beginning of the defrosting process was −55° C. A summary of the defrosting process is shown in the table below. harvest time, if they can be defrosted while maintaining a high quality, the defrosted product will yield 5~10% sashimi or sushineta. In the test conducted in this embodiment, the temperature of the frozen tuna at the beginning of the defrosting process was −55° C. Further, the control of the termination of defrosting was carried out in accordance with the method of claim 8. A summary of the defrosting process is shown in the table below.

TABLE B

| Time of Microwave Heating | Variation of Temperature | Electrical Discharge at Chamber Pressure | Chamber Pressure after 30 sec. At4torr |
|---|---|---|---|
| 1st Microwave Heating | −55.0° C. → −32.8° C. | 11.5 torr | 2.6 torr (Standard Value) |
| 2nd Microwave Heating | −33.5° C. → −17.7° C. | 2.8 torr | 2.6 torr(±0.0) |
| 3rd Microwave Heating | −19.4° C. → −10.9° C. | 3.6 torr | 2.7 torr(+0.1) |
| 4th Microwave Heating | −12.1° C. → −6.5° C. | 3.7 torr | 2.8 torr(+0.2) |
| 5th Microwave Heating | −7.2° C. → −4.0° C. | 4.5 torr | 2.9 torr(+0.3) |
| 6th Microwave Heating | −4.8° C. → −2.8° C. | 4.7 torr | 2.9 torr(+0.3) |
| 7th Microwave Heating | −3.2° C. → −1.8° C. | 6.2 torr | 3.0 torr(+0.4) |
| 8th Microwave Heating | −2.3° C. → −1.1° C. | 5.3 torr | 3.1 torr(+0.5) |

This defrosting process required 27 minutes and 50 seconds to complete. Temperature measurements taken after the defrosting process was terminated revealed an average temperature of −1.5° C. for the inside portion, and an average temperature of −1.8° C. for the outside portion. No dripping was generated. Further, because the weight after defrosting was measured at 7,936 grams, there was a loss of 64 grams due to sublimation. Accordingly, there was a loss rate of 0.8%, but the color was extremely well preserved. Then after left to stand for thirty minutes, the inside and outside temperatures were both about −1° C., and this defrosted tuna was confirmed to compare favorably with raw tuna.

Specific Embodiments 3

Thirty kilograms of frozen pork in the form of three 10-kg blocks were hung on a stainless steel rotatable jig using thin polypropylene cord, and then defrosting was carried out as this jig was rotated inside a stainless steel pressure reducing chamber having a width of 1,000 mm, a height of 1,200 mm and a depth of 1,200 mm. In this case, because a rotating jig was used, temperature measurement of the inside portion could not be carried out using an optical fiber thermometer. Further, an oil-sealed rotary vacuum pump was used at an output level of 5.5 kW, and microwave heating was carried out at an output level of 1.8 kW. In the test conducted in this embodiment, the temperature of the frozen pork at the beginning of the defrosting process was −40° C. In this regard, with a target weight loss of 0.8% established for termination of the defrosting process, the weight of the frozen pork was measured after each pressure reducing step using a load cell, and the defrosting process was terminated at the time when the weight fell below 29,760 grams (i.e., target value obtained by multiplying 30,000 grams by 0.992). A summary of the defrosting process is shown in the table below.

TABLE C

| Time of Microwave Heating | Electric Discharge at Chamber Pressure | Weight of Frozen Products at Termination of Reducing Pressure |
|---|---|---|
| Weight of Frozen Products At the Beginning of Defrosting Process | | 30,000 g (Standard Value) |
| 1st Microwave Heating | 6.5 torr | 29,990 g |
| 2nd Microwave Heating | 3.8 torr | 29,980 g |
| 3rd Microwave Heating | 4.5 torr | 29,960 g |
| 4th Microwave Heating | 3.1 torr | 29,930 g |
| 5th Microwave Heating | 3.8 torr | 29,890 g |
| 6th Microwave Heating | 3.9 torr | 29,850 g |
| 7th Microwave Heating | 4.8 torr | 29,810 g |
| 8th Microwave Heating | 5.5 torr | 29,770 g |
| 9th Microwave Heating | 6.5 torr | 29,720 g |

This defrosting process required 34 minutes and 15 seconds to complete. Temperature measurements taken after the defrosting process was terminated revealed an average temperature of −1.9° C. for the inside portion, and an average temperature of −1.5° C. for the outside portion. No dripping was generated. Further, defrosting was carried out to a level that made cooking possible immediately after defrosting.

What is claimed is:

1. A method of defrosting frozen products using microwave heating under reduced pressure, comprising the steps of:

(a) carrying out microwave heating while reducing the pressure, and further reducing the pressure, after microwave heating is terminated, to a pressure at or below the pressure at which sublimation of said frozen products takes place while supporting the frozen products with a support jig made of material having a high permeability to microwave radiation or a high reflectivity to prevent the support jig itself from being heated by the microwave radiation said support jig being constructed to minimize the contact area between said support jig and said frozen food in order to minimize heat transfer from said support jig to said frozen food;

(b) returning the pressure to a preset pressure level to enable microwave heating to be restarted; and (c) repeating steps (a) and (b) one or more times.

2. A defrosting apparatus for defrosting frozen food products, comprising:

(a) a pressure reducing chamber in which the frozen food products are placed for defrosting;

(b) a vacuum pump for reducing the pressure in the pressure reducing chamber to a pressure level at or below the sublimation pressure of said frozen food products;

(c) a microwave heating unit which can perform intermittent heating by variable power input or continual heating by a fixed power input to heat said frozen food products with microwave radiation;

(d) a support jig for supporting said frozen food products, the support jig being made from a material having a high permeability to microwave radiation or a high reflectivity; and (e) portions of said support jig that come into contact with said frozen food products having a reduced surface area which minimizes contact between said support jig and said frozen food products, said portions of said support jig comprising triangular bars, lattice shaped members, protruding members, perforated members, string members, net members or a hook element.

3. A method of defrosting frozen products using microwave heating under reduced pressure which consists essentially of the steps of:

(a) carrying out microwave heating while reducing the pressure, and further reducing the pressure, after microwave heating is terminated, to a pressure at or below the pressure at which sublimation of said frozen products takes place while supporting the frozen products with a support jig made of material having a high permeability to microwave radiation or a high reflectivity to prevent the support jig itself from being heated by the microwave radiation said support jig being constructed to minimize the contact area between said support jig and said frozen food in order to minimize heat transfer from said support jig to said frozen food;

(b) returning the pressure to a preset pressure level to enable microwave heating to be restarted; and (c) repeating steps (a) and (b) one or more times.

4. A defrosting apparatus for defrosting frozen food products which consists essentially of:

(a) a pressure reducing chamber in which the frozen food products are placed for defrosting;

(b) a vacuum pump for reducing the pressure in the pressure reducing chamber to a pressure level at or below the sublimation pressure of said frozen food products;

(c) a microwave heating unit which can perform intermittent heating by variable power input or continual heating by a fixed power input to heat said frozen food products with microwave radiation;

(d) a support jig for supporting said frozen food products, the support jig being made from a material having a high permeability to microwave radiation or a high reflectivity; and (e) portions of said support jig that come into contact with said frozen food products having a reduced surface area which minimizes contact between said support jig and said frozen food products, said portions of said support jig comprising triangular bars, lattice shaped members, protruding members, perforated members, string members, net members or a hook element.

* * * * *